United States Patent [19]

Almsted et al.

[11] 4,193,232

[45] Mar. 18, 1980

[54] WINDOW CAP

[76] Inventors: Richard Almsted, 7311 Tempo Ter., Fridley, Minn. 55432; Verlyn V. Ellertson, Wyoming, Minn. 55092

[21] Appl. No.: 946,742

[22] Filed: Sep. 29, 1978

Related U.S. Application Data

[63] Continuation of Ser. No. 827,064, Aug. 23, 1977, abandoned.

[51] Int. Cl.[2] ..... E06B 3/28

[52] U.S. Cl. ..... 52/98; 49/61; 52/202

[58] Field of Search ..... 49/475, 495, 61, 62, 49/463; 52/200, 203, 393, 403, 98, 99, 202

[56] References Cited

U.S. PATENT DOCUMENTS

| | | | |
|---|---|---|---|
| 1,131,737 | 3/1915 | Rockwell | 49/475 X |
| 2,790,400 | 4/1957 | Wasserman | 52/395 X |
| 2,899,238 | 8/1959 | Swanson | 49/479 X |
| 2,916,112 | 12/1959 | Kiehl | 52/98 |
| 3,307,303 | 3/1967 | Bloxsom | 52/200 X |
| 3,350,823 | 11/1967 | Murray | 52/200 |
| 3,405,487 | 10/1968 | Van De Kerke | 52/200 |
| 3,822,462 | 7/1974 | Chubb | 52/208 X |
| 3,835,602 | 9/1974 | Turri | 52/200 X |
| 3,868,804 | 3/1975 | Tantlinger | 52/98 |

FOREIGN PATENT DOCUMENTS

| | | | |
|---|---|---|---|
| 2430182 | 1/1976 | Fed. Rep. of Germany | 52/200 |
| 1,099,495 | 3/1955 | France | 52/202 |
| 1,301,392 | 12/1972 | United Kingdom | 52/200 |

*Primary Examiner*—Alfred C. Perham
*Attorney, Agent, or Firm*—John W. Adams

[57] ABSTRACT

A pan shaped window cap having a window pane with a peripheral edge and at least one side extending around the edge of and generally perpendicularly to said window pane, and wherein each side includes means for attachment of the window cap to the siding of a building beyond a window frame to completely encompass a window and its frame.

8 Claims, 6 Drawing Figures

WINDOW CAP

This is a continuation of application Ser. No. 827,064, filed Aug. 23, 1977, now abandoned.

BACKGROUND AND FIELD OF THE INVENTION

Briefly, the invention relates to energy conservation in general, to reduction of heat loss from a building in particular, and specifically to apparatus for such reduction occurring through the window area of a building.

Humanity's battle to conserve and most efficiently utilize the energy generated to heat buildings is ancient. Aesthetics, perhaps a need to feel unconfined, no matter what the reason, ever since building materials and techniques have permitted, a significant amount of the wall area, and even of the roof area in some instances, of a building has been windows. Much effort has been expended towards minimizing heat loss at a window area, symbolized by the universal acceptance, for decades, of storm windows. Less conspicuous but of even greater antiquity are various chinking, weatherstripping, and calking means for sealing a window frame to building interface. Some concessions have been made in the crusade against heat loss in the case of storm windows for the sake of user convenience. Lightweight windows having aluminum frames which are completely and totally useable and operable, including removal for cleaning, from inside a building, but which have a greater heat loss than wood frame windows, have been in widespread use for many years.

A general object of the invention is an article which reduces heat losses from a window area.

A specific object of the invention is a window cap which reduces heat loss both through the window glass and from the window frame to building interface portions of a window area.

Another object of the invention is a window cap which is modular.

An additional object of the invention is a window cap which provides a seal even against irregular building siding such as stucco, brick, and conventional lapped siding.

Yet another object of the invention is a window cap which fully encompasses even a window frame the top of which abuts a building soffit.

A further object of the invention is a window cap which can be stacked in a nesting relationship with another window cap.

BRIEF DESCRIPTION OF THE INVENTION

Briefly, the invention comprises a window cap which encompasses an entire window area, including the window frame to building interface.

According to a preferred embodiment of the invention, the vertical sides of the invention include a resilient seal slit crossways at regular intervals. In this way a tight seal is provided against a building, including all along the vertical sides even for an overlapped, stucco, or brick siding building.

DETAILED DESCRIPTION OF THE INVENTION

Figure 1:
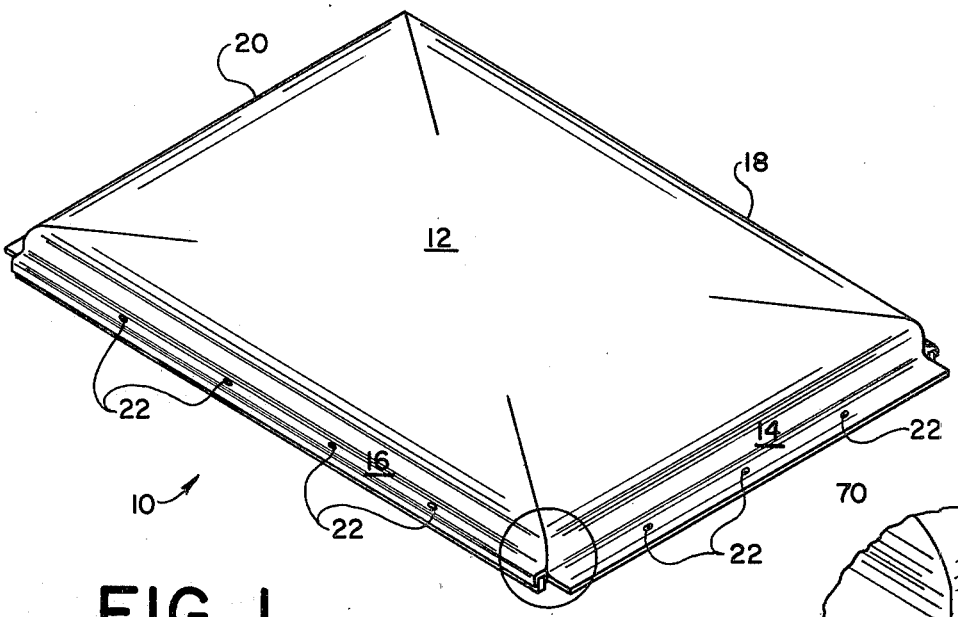
FIG. 1 is a perspective view, including an enlarged view of one corner, of a window cap according to the present invention.
Figure 1A:
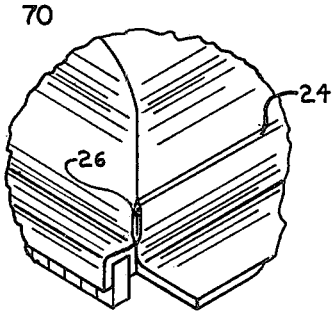
Figure 4:
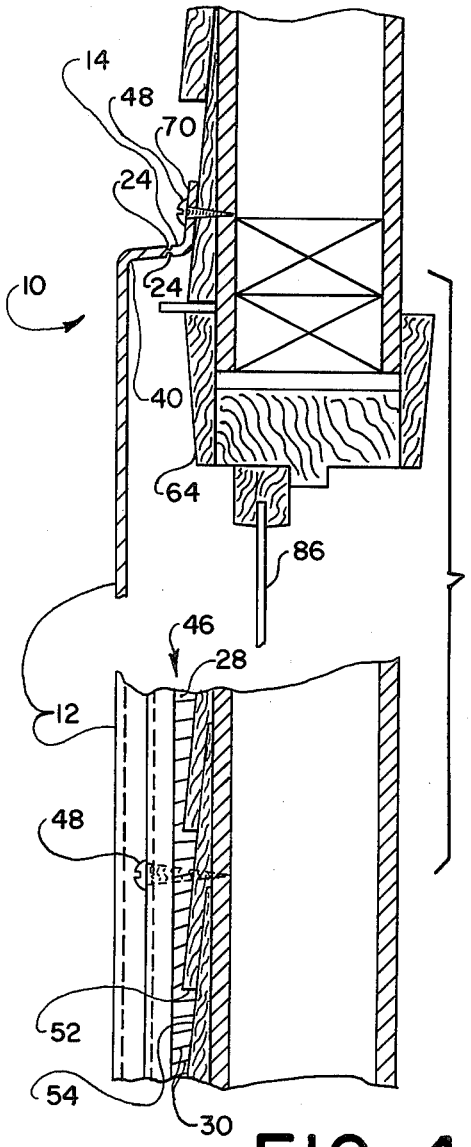
FIG. 4 is a fragmentary vertical sectional side view of a window cap of FIG. 1 attached to a building.
Figure 5:
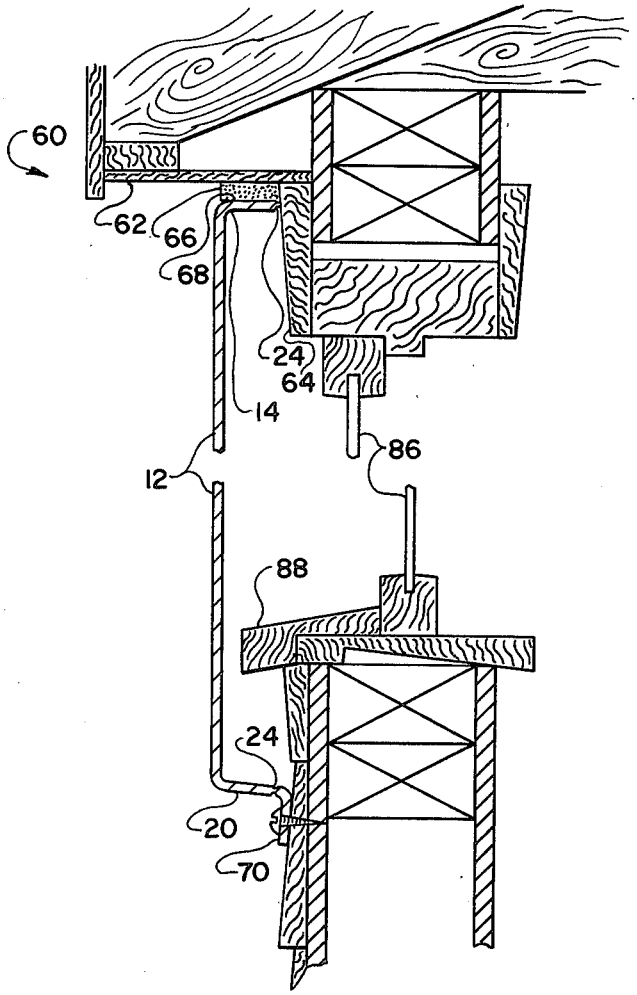
FIG. 5 is a fragmentary vertical sectional side view of a window cap according to FIG. 1 attached to a building having a window the top frame of which abuts the building soffit; and, FIG. 6 is a fragmentary horizontal sectional view of two window caps according to FIG. 1 modified and joined together as an integral unit and attached to a building.
Figure 6:
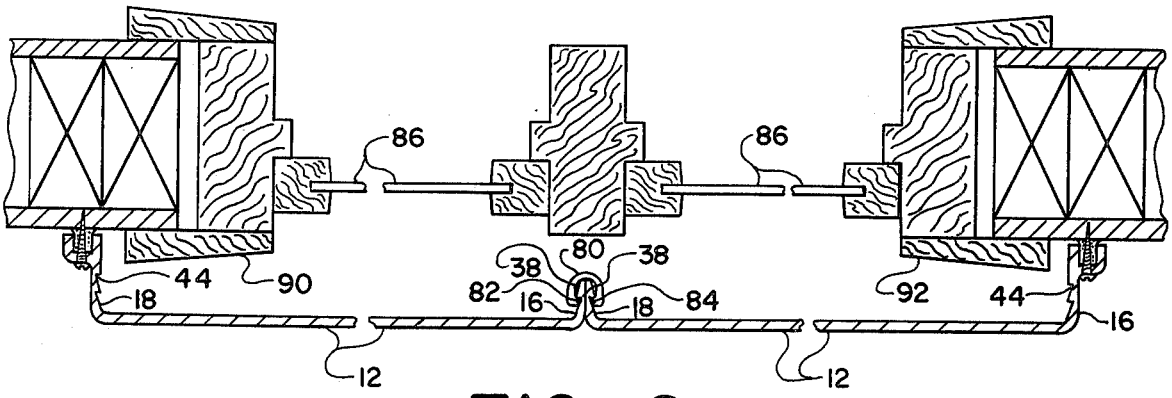

A perspective view of a window cap according to a preferred embodiment of the invention is shown generally as 10 in FIG. 1, and comprises a window panel 12, top horizontal side 14, vertical sides 16 and 18, and horizontal bottom side 20. All of said sides combine to form a spacer element to position the panel 12 in outwardly spaced relation to the window and frame unit as shown in FIGS. 4, 5, and 6. Means for attachment of the window cap 10 to a building, apertures 22, are included in each of sides 14, 16, 18, and 20. FIG. 1 includes an enlarged view in which it can more easily be seen that side 14 includes a score 24 and that the corner seam between sides 14 and 16 similarly includes a crease 26 which extends part way up the corner. Score 24 extends the full width of side 14 and an identical score 24 extends across side 20 although it is hidden from view in FIG. 1. Each corner seam includes a crease 26.

Figure 2:
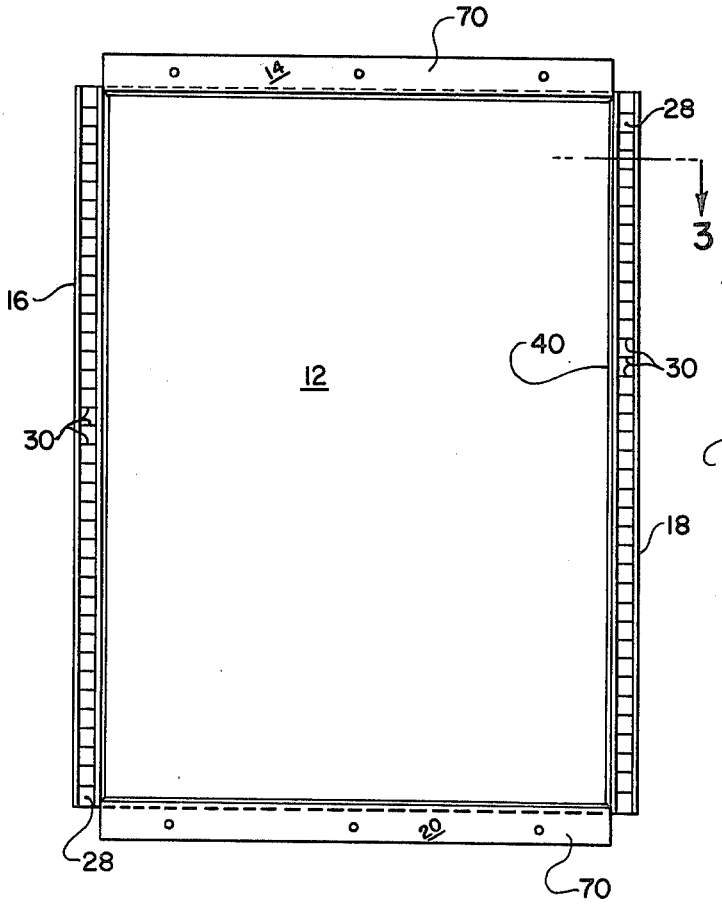
FIG. 2 is a bottom plan view of the window cap of FIG. 1.

A bottom plan view of the window cap 10 of FIG. 1 is shown in FIG. 2, and illustrates that a resilient seal 28 having crossways slits 30 is included in each of vertical sides 16 and 18.

Figure 3:
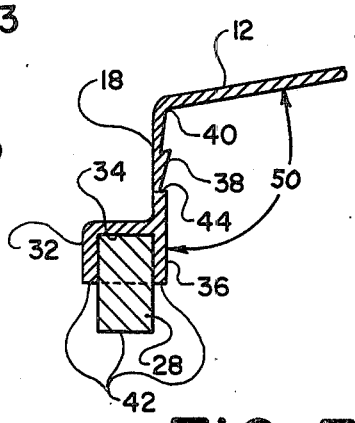
FIG. 3 is a sectional view taken along line 3 of FIG. 2.

FIG. 3 is a cross section taken along line 3 of FIG. 2 which shows that seal 28 sits in a channel formed by an outer wall 32, bottom surface 34, and inner wall 36. Vertical side 18 (as does the vertical side 16, not shown) includes a barb 38 between peripheral edge 40 of window pane 12 and the side 18 outer edge 42, the latter of which comprises the ends of the channel walls 32 and 36 and of the end of seal 28. A separation line 44 is included between each barb 38 and outer edge 42 to facilitate removal of seal 28 and its channel for joinder of one window cap with another which has also had a seal 28 and its channel removed. By definition, each peripheral edge 40 of a window pane 12 is located midway between the ends of the radius joining or, as the case may be, the juncture of the side (side 18 in the case of FIG. 3) and window pane 12. In FIG. 3 it can be seen that the included angle designated as 50 between side 14 and pane 12 is an obtuse angle selected, together with the thickness of the cap sides, to provide nesting of one cap within another.

FIG. 4 is a fragmentary side view of a window cap 10 attached to a building having lap siding shown generally as 46 by means of conventional wood screws 48 inserted through apertures 22. Slits 30 permit an abrupt and marked change in the degree of compression of resilient seal 28 to provide a highly efficient seal of a vertical edge to the side of a building, even at the point of overlap of a bottom 52 with a face 54 of the lap siding 46, and for all similarly irregular siding buildings. In FIG. 4 it can also be seen that score 24 is a double score, i.e. a score on both the inside and the outside.

FIG. 5 is a fragmentary vertical cross-sectional view of a window cap 10 attached to a building which includes a conventional eave shown generally as 60 which has a soffit 62 and a window the top frame 64 of which abuts soffit 62. Total encompassment of such a window is accomplished by wedging a compression strip 66 between the outer face 68 of top side 14 and soffit 62, after removal of the side 14 attachment flange 70 by fracturing side 14 along score 24 and up each of the creases 26 in the seams between side 14 and each of sides 16 and 18.

FIG. 6, a fragmentary, horizontal, sectional view, illustrates the modularity of the present invention. A pair of window caps 10 are formed into a double window cap by severing a channel and its seal 28 from a vertical side along separation line 44 of each of the window caps 10. The two so shortened sides are secured together with a barbed sleeve 80 which includes internal barbs 82 and 84 spaced for mating engagement with the barbs 38 of each of the vertical sides.

In the foregoing drawings, the glass of a window in each instance is designated as 86, the window sill as 88, and sides of the window frame as 90 and 92. According to the present invention, a window cap is provided which totally encompases an entire window area. A window cap is provided which extends beyond the entire window frame to building interface. Attachment beyond the window frame top 64 is illustrated in FIGS. 4 and 5; beyond the sides 90 and 92 is illustrated in FIG. 6; and, beyond the bottom or window sill 88 is illustrated in FIG. 5.

A window cap according to the present invention can be manufactured or fabricated from any of a variety of well known, readily available materials by well known processes. It is believed a clear plastic material vacuum formed or cold pressed would be the best mode for carrying out the invention.

The foregoing is given by way of illustration and not limitation and modifications and variations thereof deemed obvious to one of ordinary skill in the art are considered encompassed within the invention. For example, again by way of illustration and not limitation, window cap 10 could be provided with a seal 28 on each of its four sides. The true scope of the invention is set forth in the following claims.

What is claimed is:

1. In combination with a wall of a building including a window and window frame unit mounted in the building wall, a window cap attached in fixed sealed relation to the building wall and completely enclosing the window and frame unit, said window cap comprising:

a window pane having a peripheral edge; and also having a peripheral spacer element extending around said window pane peripheral edge and being larger in all dimensions than the window frame to completely surround and enclose the window and frame unit, said peripheral spacer element being sufficiently thick to space said pane outwardly from the window and frame unit, and means for sealing the spacer elements to a portion of said building wall surrounding and enclosing said window frame.

2. A window cap according to claim 1 wherein said side includes a barb at least partially along said side inwardly of said outer edge.

3. A window cap according to claim 2 further comprising a separation line between said outer edge and said barb.

4. The combination according to claim 1 wherein said sealing attachment means includes a resilient seal.

5. A window cap according to claim 4 wherein said resilient seal is slit across and at least part way through at intervals along the seal.

6. A window cap according to claim 5 wherein said intervals are substantially equal in length.

7. A window cap according to claim 1 wherein said peripheral spacer element comprises a pair of opposing vertical sides and a pair of opposing horizontal sides all of said sides being formed in a unit with said pane.

8. A window cap according to claim 7 wherein each said horizontal side includes a score to facilitate removal of a selected flange.

* * * * *